United States Patent [19]

von Winckelmann

[11] 4,232,479

[45] Nov. 11, 1980

[54] TOY RACING CAR

[76] Inventor: Emil H. von Winckelmann, 7731 Amestoy St., Van Nuys, Calif. 91406

[21] Appl. No.: 948,688

[22] Filed: Oct. 5, 1978

[51] Int. Cl.[3] ..... A63H 17/36

[52] U.S. Cl. ..... 46/262; 46/257; 273/86 B

[58] Field of Search ..... 46/262, 253, 257, 251, 46/248, 259; 104/60, 149; 273/86 B

[56] References Cited

U.S. PATENT DOCUMENTS

| | | | |
|---|---|---|---|
| 3,751,851 | 8/1973 | Nagai | 46/251 X |
| 3,871,129 | 3/1975 | Tong | 46/262 |
| 4,079,938 | 3/1978 | Beny et al. | 46/262X |
| 4,156,987 | 1/1979 | Lahr | 46/253 |

FOREIGN PATENT DOCUMENTS

| | | | |
|---|---|---|---|
| 1498775 | 1/1978 | United Kingdom | 46/262 |

*Primary Examiner*—Robert Peshock
*Assistant Examiner*—Mickey Yu
*Attorney, Agent, or Firm*—Keith D. Beecher

[57] ABSTRACT

An electrically energized toy racing car is provided which includes an improved steering mechanism that permits the car to be steered to the right or left depending upon the polarity of the direct-current voltage applied to its drive motor. The car is intended to be raced on a specially constructed track which includes electrically conductive strips extending along its length, the strips providing electrical energizing current for the drive motor. The steering is accomplished by a gear train which causes the front or rear axle of the car to turn in a limited amount in one direction or the other depending upon the polarity of the voltage applied to the drive motor, as the car is driven in the forward direction.

5 Claims, 7 Drawing Figures

TOY RACING CAR

BACKGROUND OF THE INVENTION

Electrically energized toy racing cars are known which may be raced against one another. It is usual in the prior art to provide a track with side walls for use with such cars, and for the cars to be controlled so that they may be steered so as to be biased against one or the other of the side walls, this being achieved by selecting the polarity of the direct-current voltage applied to the electric drive motor in each car, the voltage being applied through electrically conductive strips extending along the track. Prior art cars are steered by mounting the rear wheels to be individually rotatable on the rear axle, and by providing a somewhat complex gear train from the motor such that one or the other rear wheel is driven in the forward direction depending upon the direction of rotation of the motor which, in turn, depends upon the polarity of the direct current voltage applied to the motor. The action tends to cause the car to be biased to the left or right against the adjacent wall depending on the polarity of the voltage applied to the motor.

The steering mechanism of the toy racing car of the present invention, unlike the steering mechanism in the prior art cars, provides a steering control, which is achieved by actually turning the front or rear wheel axle a limited amount in one direction or the other through a gear train included in the steering mechanism. The steering mechanism of the invention is simpler and less expensive than the mechanism used in the prior art cars, and it provides a more direct and positive steering control.

DETAILED DESCRIPTION OF THE ILLUSTRATED EMBODIMENT

Figures 1, 2:
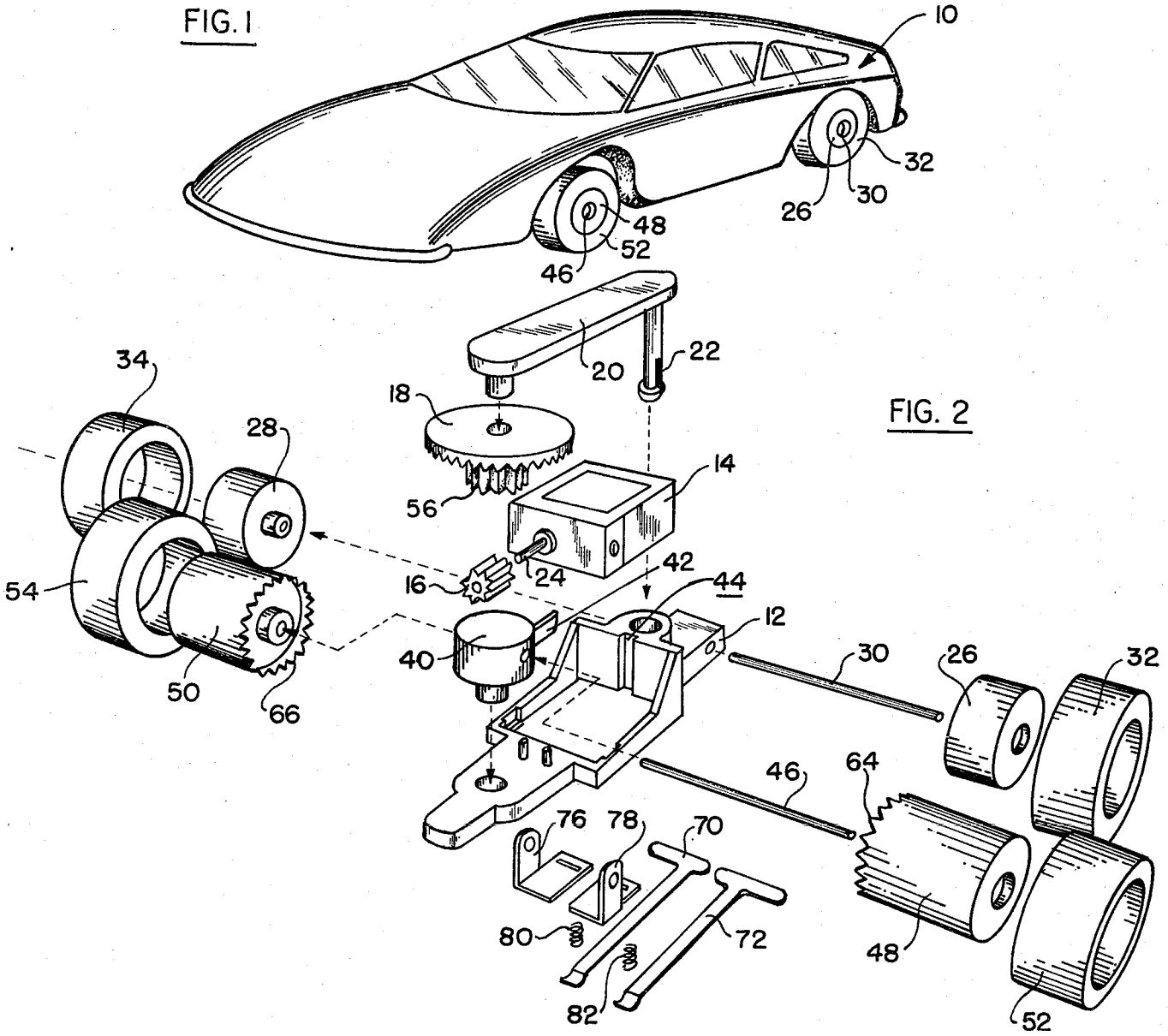
FIG. 1 is a perspective view of a toy racing car which may be constructed to incorporate one embodiment of the improved steering mechanism of the present invention.
FIG. 2 is an exploded perspective representation of the internal mechanism of the car of FIG. 1, representing one embodiment of the invention.

The toy car shown in FIG. 1 is designated generally as 10. As shown in FIG. 2, the internal mechanism of the car 10 includes a chassis 12. An electric motor 14 is mounted on the chassis 12, and the motor drives a drive gear 16 through a drive shaft 24. Gear 16, in turn, engages a crown gear 18 which is mounted on the distal end of an arm 20, the arm being pivotally mounted on chassis 12 by means of a post 22.

The rear wheel hubs 26 and 28 of the car are mounted on an axle 30, and are clamped to the axle. Each wheel hub is provided with a tire, such as the tires 32 and 34.

A steering member 40 is mounted on chassis 12 for limited angular movement about a vertical axis, the angular movement of the steering member being limited by a radial projection 42 which extends into a slot 44 in the chassis.

The vehicle has a front axle 46 which extends through the steering member 40; and front wheel hubs, such as the hubs 48 and 50 are clamped to the respective ends of the axle. Tires, such as the tires 52 and 54 are respectively mounted on the hubs. A gear 56 is formed integral with the crown gear 18, and it is positioned such that when the motor 14 is driven in one direction, the crown gear 18 causes gear 56 to engage a crown gear 64 formed at one end of hub 48; and when motor 14 turns in the opposite direction, the crown gear 18 causes arm 20 to swing in the opposite direction so that gear 56 engages a crown gear 66 formed at the inner end of hub 50.

Therefore, when motor 14 is energized for rotation in a first direction, gear 56 engages gear 64, causing the front wheel hubs 48 and 50 to turn in the forward direction, but with the axle 46 and steering member 40 turned about the vertical axis an extent limited by radial projection 42, to steer the car in one direction; and when the direction of rotation of the motor 14 is reversed, gear 56 engages gear 66, again to cause the front wheels to turn in the forward direction, but to swing the axle 46 and steering member 40 about the vertical axis in the opposite direction, so that the car is turned in the other direction.

As an alternative, the front wheel axle 46 may be fixed and incapable of turning about the vertical axis, and the turning member 40 shifted to the rear wheel axle 30, so that the rear wheel axle is capable of limited rotation about a vertical axis for steering purposes. The post 22 is then keyed to the turning member so that steering is effectuated and the car is turned in one direction or the other depending upon the direction of rotation of motor 14.

Figure 3:
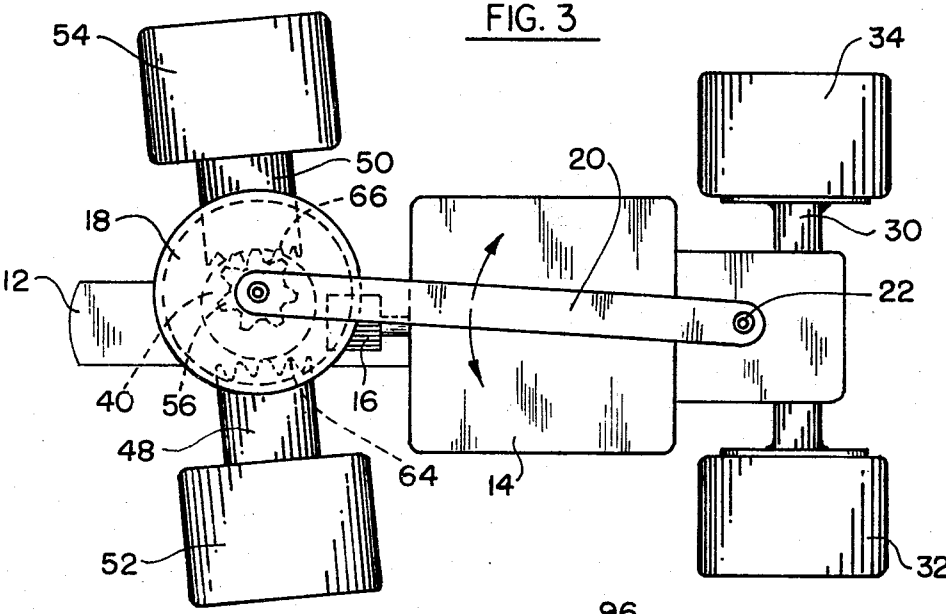
FIG. 3 is a top plan view, in schematic form, showing the mechanism of the embodiment of FIG. 2.

The motor 14 is energized by two contact sliders 70 and 72 which are connected respectively to a pair of contact plates 76 and 78, the contact plates being connected to the motor 14. The sliders 70 and 72 are spring-biased by springs 80 and 82 against electrically conductive strips 96 and 98 which are provided on the track (FIG. 3). The motor 14 is a direct current motor, so that when a direct current voltage of a first polarity is applied across the strips 96 and 98, the motor is energized with a particular polarity and rotates in a first direction; and so that when a voltage of an opposite polarity is applied across the strips, the motor is energized to turn in the opposite direction. In this way, steering may be effectuated, as described above.

Figure 5:
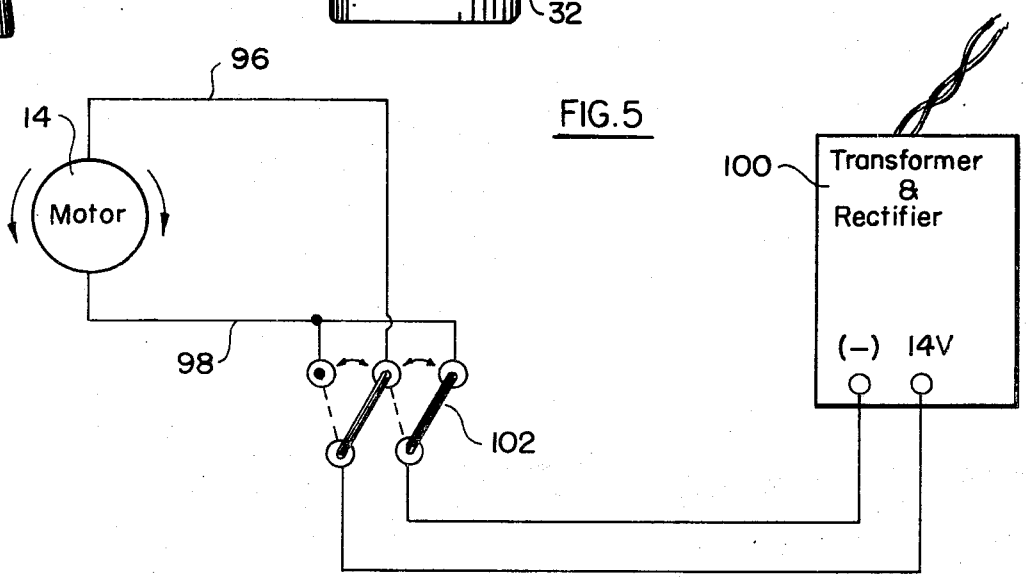
FIG. 5 is a circuit diagram showing the manner in which the car of FIG. 1 may be electrically energized and controlled.

As shown in FIG. 5, a transformer and rectifier unit 100 is connected to the strips 96 and 98 through a reversing switch 102; the strips, in turn, being connected to the motor 14 through the sliders 70, 72 and contact plates 76, 78.

To operate the car, the switch 102 is placed in one position or the other, so that the car may be driven forwardly along the track. The car may then be turned in one direction or the other, by controlling switch 102. The car is always controlled to tend to turn in one direction or the other, against a side wall, for example, or other restraining means such as described in copending application Ser. No. 949,970 filed Oct. 10, 1978 in the name of the present inventor.

Figure 4:
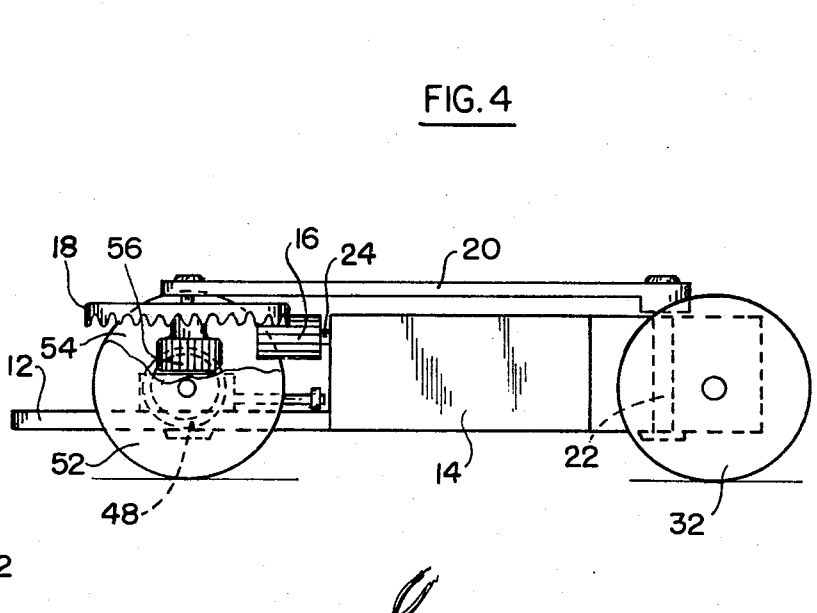
FIG. 4 is a side elevational view, in schematic form, of the mechanism of FIG. 3.
Figure 6:
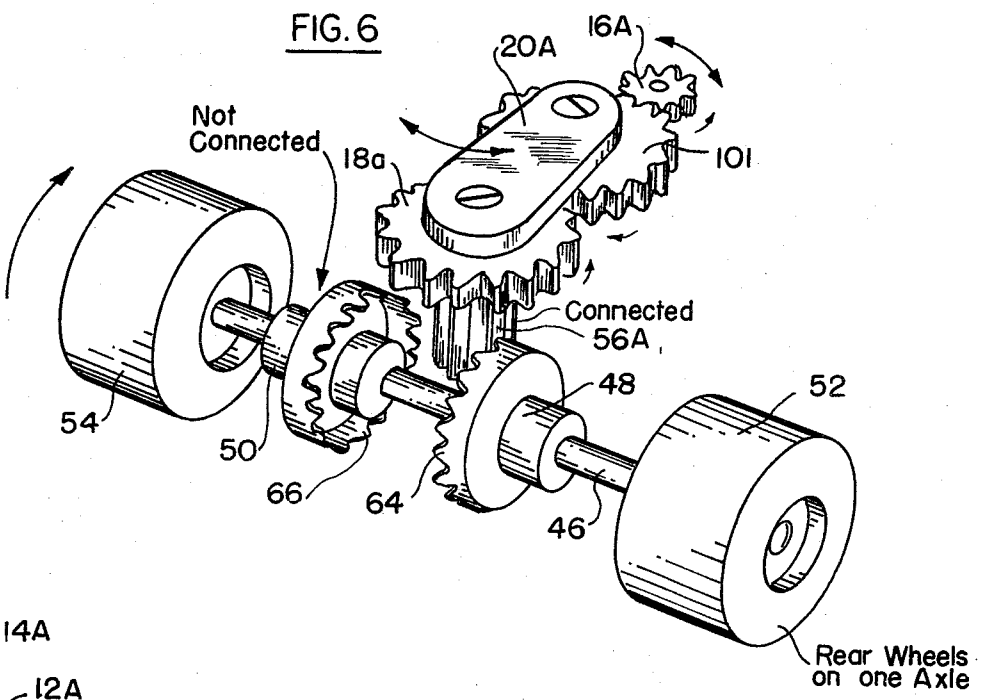
FIG. 6 is a perspective representation of a portion of the internal mechanism of the car of FIG. 1, in accordance with a second embodiment of the invention.
Figure 7:
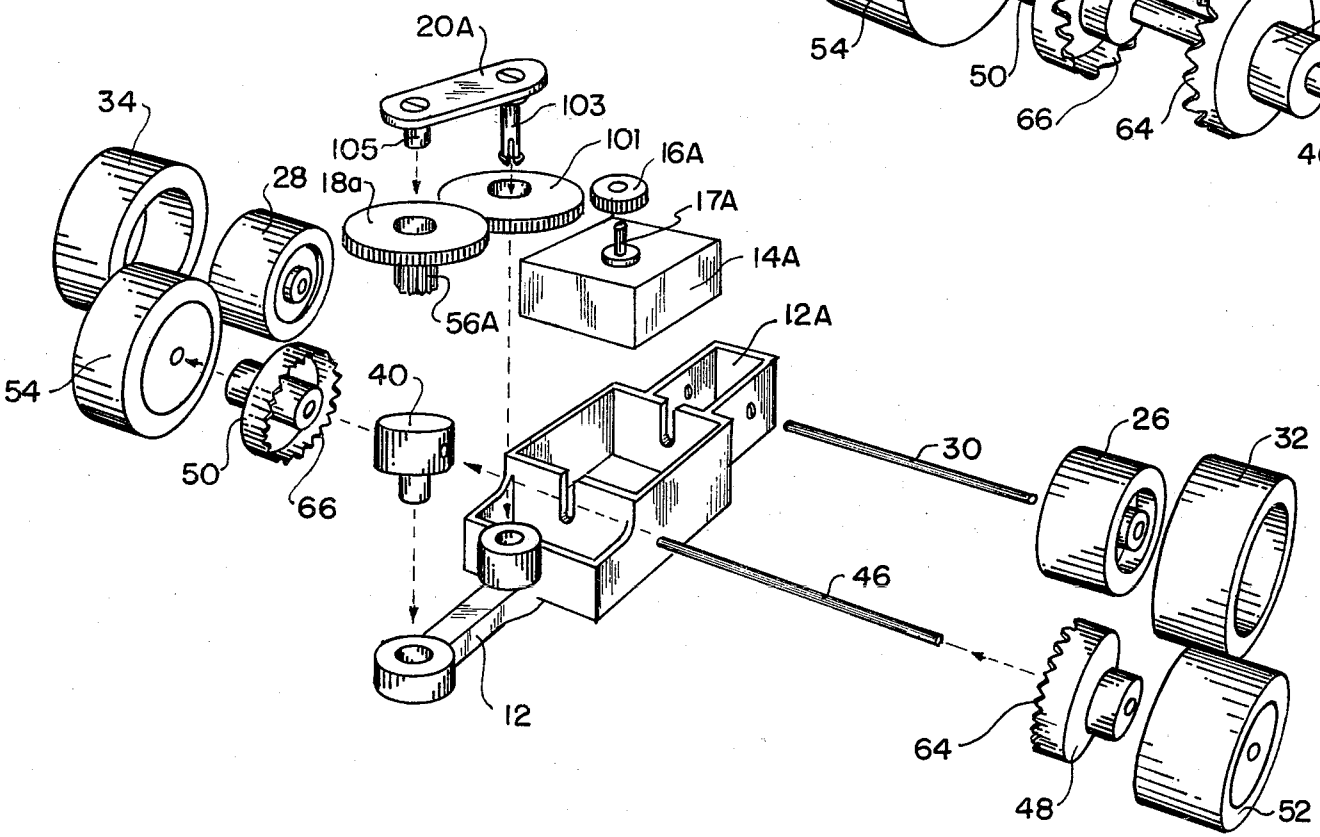
FIG. 7 is an exploded perspective representation of the internal mechanism of the second embodiment.

The embodiment of FIGS. 6 and 7 is similar in some respects to the embodiment of FIGS. 2–4, and like components have been designated by the same numbers.

The latter embodiment includes a pancake motor 14*a* which is received in chassis 12*a*, and which has a drive shaft 17*a* connected to a drive gear 16*a*. Drive gear 16*a* engages an idler gear 101 which, in turn, engages a second gear 18*a*. Gear 101 is supported on a pin 103 which is rotatably received in chassis 12*a*, and pin 102 is mounted on one end of an arm 20*a* which has a shaft 105 at its other end which rotatably supports the gear 18*a*. Gear 18*a* has a second gear 56*a* formed integral with it in coaxial relationship, and when the motor is energized so that its drive shaft 17*a* and drive gear 16*a* turns in a first direction, gear 101 swings the arm 20*a* in one angular direction to cause gear 56*a* to engage crown gear 64. On the other hand, when the motor 14*a* is energized so that its drive shaft 17*a* turns in the opposite direction, gear 16*a* causes gear 101 to swing gear 56*a* against the crown gear 64. The foregoing action causes the front axle 46 to turn in the steering member 40 a limited amount in one direction or the other to achieve the steering action described above.

The invention provides, therefore, an improved toy racing car which includes an internal steering mechanism which is simpler and less expensive than the mechanisms used in the prior art racing cars, and which serves actually to turn the front or rear axle of the car in one direction or the other so as to achieve the desired steering action.

It will be appreciated that while particular embodiments of the invention have been shown and described, modifications may be made. It is intended in the claims to cover the modifications which come within the spirit and scope of the invention.

What is claimed is:

1. A toy car including: a chassis; an electrically energized drive motor mounted on the chassis and having a drive shaft; a plurality of wheels for the car mounted on the chassis; an axle for supporting two of the wheels at the respective ends thereof, each of said wheels including a hub clamped to the axle and each of the hubs having a gear affixed thereto; means for mounting the axle on the chassis for angular movement thereof about a vertical axis for steering purposes; and means including a gear train coupling the drive shaft of the motor to the axle for transmitting forward motion to the car and for causing the axle to turn angularly in one direction of the other about the vertical axis depending upon the direction of rotation of the motor, said gear train including a drive gear, a pivotally mounted arm supporting the drive gear on its distal end and angularly movable about a pivot axis to cause the drive gear selectively to engage the gears affixed to the hubs of the two wheels, a further gear coaxial with said drive gear and affixed thereto, and gear means coupling the further gear to the drive shaft of the motor.

2. The toy car defined in claim 1, in which the axle is mounted at the forward end of the chassis, and the two wheels mounted on the respective ends of the axle constitute the front wheels of the car.

3. The toy car defined in claim 1, in which said axle is mounted on the forward end of the chassis, and which includes a further axle mounted on the rear end of the chassis, and in which the two wheels mounted on the ends of the first named axle constitute the front wheels of the car, and which includes two wheels mounted on the ends of said further axle to constitute the rear wheels of the car.

4. The toy car defined in claim 1, in which said further gear is a crown gear and in which said gear means comprises a gear keyed to the drive shaft of the motor and engaging said crown gear.

5. The toy car defined in claim 1, in which said gear means comprises a gear keyed to the drive shaft of the motor, and an idler gear coupling the last-named gear to the further gear.

* * * * *